United States Patent [19]

Farmer

[11] 4,191,092

[45] Mar. 4, 1980

[54] TELESCOPIC RAM

[75] Inventor: Stanley E. Farmer, Troutdale, Oreg.

[73] Assignee: Cascade Corporation, Portland, Oreg.

[21] Appl. No.: 852,108

[22] Filed: Nov. 16, 1977

[51] Int. Cl.[2] ..... F15B 11/18; F01B 7/20

[52] U.S. Cl. ..... 91/189 R; 91/168; 91/422; 91/454

[58] Field of Search ..... 91/168, 169, 189 R

[56] References Cited

FOREIGN PATENT DOCUMENTS

| | | | |
|---|---|---|---|
| 1240743 | 5/1967 | Fed. Rep. of Germany | 91/168 |
| 1933457 | 7/1970 | Fed. Rep. of Germany | 91/168 |
| 877869 | 9/1961 | United Kingdom | 91/168 |

*Primary Examiner*—Paul E. Maslousky

*Attorney, Agent, or Firm*—Kolisch, Hartwell, Dickinson & Stuart

[57] ABSTRACT

A three-stage, four-section telescopic ram employing a plurality of internal fluid passages, with valving provided in certain of these passages, to produce a uniform overall extension speed when pressure fluid is supplied to the ram at a substantially constant rate.

4 Claims, 5 Drawing Figures

TELESCOPIC RAM

BACKGROUND AND SUMMARY OF THE INVENTION

This invention pertains to a three-stage, four-section telescopic hydraulic ram which is especially adapted for use in conjunction with a triple-lift-type mast in a lift truck.

Many industrial lift trucks are equipped with a so-called triple-lift-type, vertically extensible-contractible mast. Such masts include inner, intermediate and outer sections which are extensible vertically relative to one another, with the inner section carrying a carriage on which any one of a variety of load-handling attachments, such as lift forks, may be mounted. The carriage is disposed for travel up and down on and along the inner mast section during what is normally referred to as the "free-lift" operating stage of the truck. Raising and lowering of such a mast is accomplished through mechanism substantially always including a multi-section hydraulic ram, with various sheaves and chains used to provide operative interconnections between the ram and the mast sections.

A number of features are usually sought in such an arrangement. As an illustration, it is important that, during times when a lift truck is being driven and maneuvered from one location to another, the operator have good forward visibility. Under such a driving situation, it is usual that a mast and ram are substantially fully contracted or lowered.

Further, and in order to avoid jolting of a load as it is being raised or lowered, it is desirable that the raising and lowering speed of the carriage, throughout the entire vertical range of travel of the carriage, be as constant as possible. Jolting will occur, of course, if any abrupt change in speed takes place. Obviously, such jolting presents the serious hazard of dropping a load, and causing personal injury and/or other damage.

A general object of the present invention, therefore, is to provide a novel multistage ram which is capable of being incorporated with a triple-lift-type mast in a lift truck in a manner which will take all of the above-mentioned concerns and considerations into account in a practical and satisfactory manner.

According to a preferred embodiment of the invention, the proposed ram comprises a single-acting, four-section, three-stage construction, including a cylinder, an outer large piston slideably received within and extensible from the cylinder, an intermediate piston slideably mounted within and extensible from the outer piston, and an inner piston slideably mounted within and extensible from the intermediate piston.

Provided within the ram of the invention are plural internal fluid passages, with valving mounted in certain of these passages, which direct fluid flow within the ram so as to produce a substantially uniform overall extension speed for the ram when pressure fluid is supplied thereto at a substantially constant rate. The details of construction and location of these passages will be described fully in the description of the ram presented below.

A further important feature of a preferred embodiment of the ram (as disclosed herein) is that it offers an extremely simple construction which is inexpensive to manufacture, and which further presents few maintenance concerns.

The ram of the instant invention can readily be incorporated with a triple-lift-type mast to produce the desired kind of smooth performance mentioned above as being important. The fact that the ram includes four sections ensures its having a relatively short overall length when fully contracted—a condition which contributes significantly to good forward visibility for a truck operator (with the truck and mast in the usual configuration used during transporting of a load).

These and other objects and advantages which are attained by the invention will become more fully apparent as the description which now follows is read in conjunction with the accompanying drawings.

DETAILED DESCRIPTION OF THE INVENTION

Figures 1, 2, 3, 4, 5:
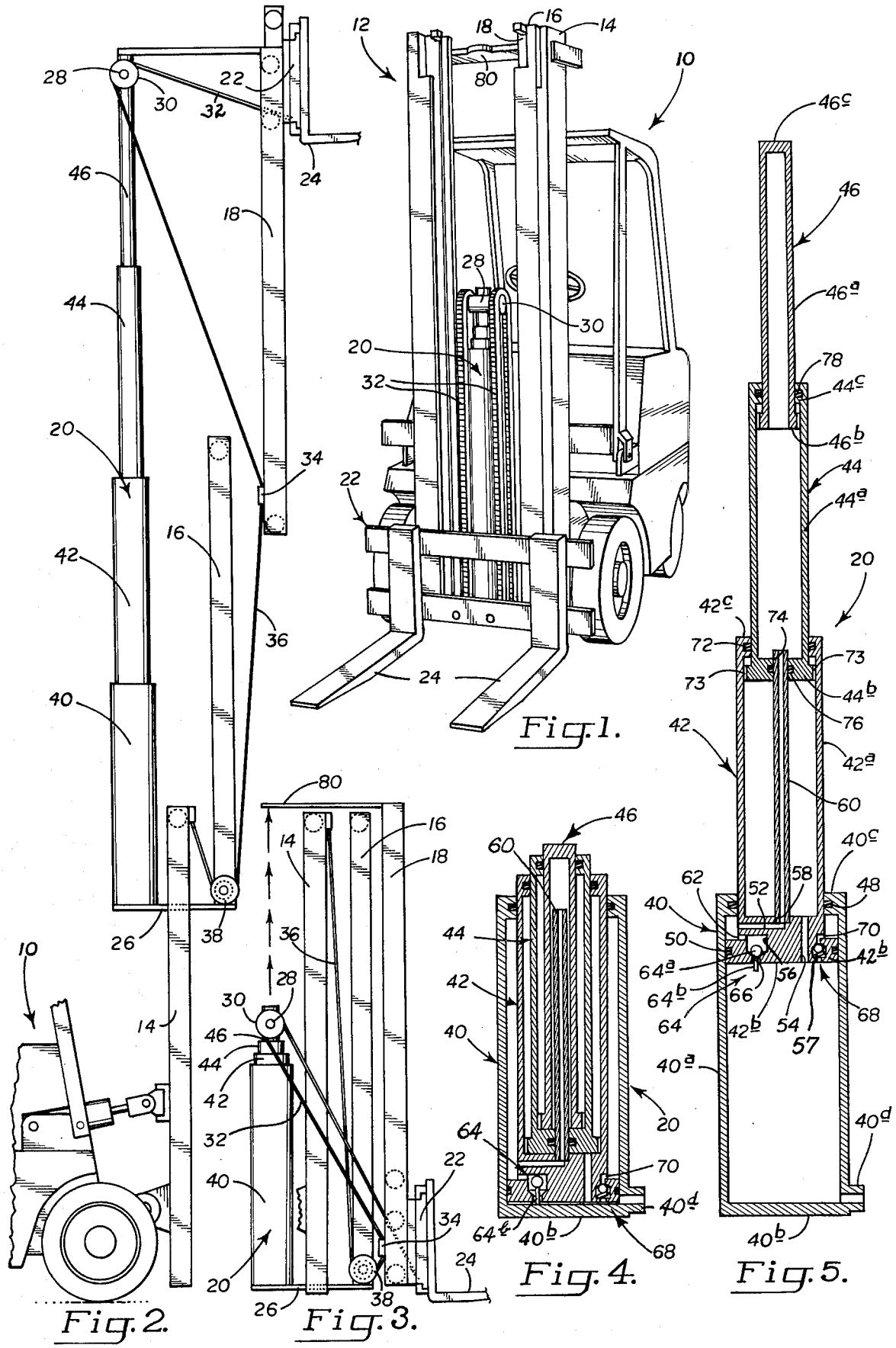
FIG. 1 is a front perspective view showing a lift truck with a triple-lift-type mast which is raised and lowered by a telescopic ram constructed in accordance with the present invention.
FIGS. 2 and 3 are simplified schematic side elevations showing two different stages of lift which are effected by operation of the ram in the truck of FIG. 1.
FIGS. 4 and 5, which are on a larger scale than the other figures, are simplified schematic drawings showing the internal construction of the ram of the invention, with FIG. 4 showing the same in a fully contracted condition, and FIG. 5 showing the same in a fully extended condition.

Turning now to the drawings, and referring first to FIGS. 1–3, inclusive, indicated generally at 10 is a conventional industrial lift truck, on the front of which is mounted a three-section telescopic mast 12. Mast 12 includes outer, intermediate and inner mast sections 14, 16, 18, respectively, which are adapted for vertical extension relative to one another with operation of a three-stage, fluid-actuated, single-acting ram 20 which is constructed in accordance with the present invention. A conventional carriage is shown at 22—this carriage being roller-mounted in a conventional manner for travel up and down on and along inner mast section 18. The three sections of the mast are also roller-mounted with respect to each other.

As is well understood, carriage 22 is adapted for mounting thereon of a wide variety of load-handling attachments. Shown in FIG. 1 as being mounted on carriage 22 are two lift forks 24.

Referring for a moment to the schematic drawing in FIG. 2 along with the drawing of FIG. 1, the base of ram 20 is suitably seated herein upon intermediate mast section 16. The means provided for such seating is shown schematically in FIG. 2 as a plate 26—this plate being shown near the base of the intermediate mast section. The upper end of ram 20 carries what is known as a crosshead 28 on which are mounted a pair of sheaves, such as sheave 30, over which are trained two carriage chains 32. As can be seen particularly in FIG. 2, one set of ends of these chains is anchored at 34 to the lower end of inner mast section 18. The other set of ends of the chains is suitably anchored to carriage 22.

With further reference still to FIG. 2, also included in the means which interconnects ram 20 and mast 12 are two so-called bootstrap chains, one of which is shown at 36 in FIG. 2. One set of ends of chains 36 is anchored at the upper end of outer mast section 14. The other set of ends of these chains is secured to the inner mast section at the location of previously mentioned anchor 34. Between their ends, the bootstrap chains are trained over sheaves, such as sheave 38, which are journaled near the base of intermediate mast section 16.

Neither the details of construction of mast 12, nor of the specifics of the interconnections between the mast and ram 20 are of any consequence to the present invention, and hence will not be discussed herein in any further detail. However, a mast like that which is generally illustrated herein, and which is entirely satisfactory, is fully described in U.S. patent application Ser. No. 630,782, filed Nov. 11, 1975, now abandoned, by for A. Empke, Harlan D. Olson and Harry F. Weinert for "Telescopic Mast For Industrial Lift Truck."

As is contemplated by the present invention, ram 20 takes the form of a three-stage, four-stage assembly, or extensible-contractable device. Considering FIGS. 4 and 5 along with the other figures, the four sections of the ram are shown at 40, 42, 44, 46. Section 40 is also referred to herein both as a cylinder and as a fourth section, section 42 as an outer member and as a third section, section 44 as an intermediate member and as a second section, and section 46 as an inner member and also as a first section. Section 42 is slideably mounted within and extensible from section 40; section 44 is similarly mounted with respect to section 42, and section 46 is similarly mounted with respect to section 44.

As was mentioned earlier in the description of the drawings, in FIGS. 4 and 5, the ram of the invention is illustrated in simplified schematic form. For example, the different ram sections are shown, for the sake of simplicity, as being constructed from unitary pieces of material. It will be appreciated by those skilled in the art that the actual constructions of the ram sections may include multiple parts suitably joined, and that such configurations may take any one of a number of different forms, none of which is critical to the present invention.

Referring now specifically to FIGS. 4 and 5 (FIG. 4 omitting some of the reference characters), cylinder 40 includes a tubular portion **40*a* formed at its bottom end with a base 40*b* and at its top end with a collar 40*c*. Adjacent base 40*b* is a port, or port means, 40*d* which accommodates the supply and exhaust of pressure fluid to exend and contract the ram, respectively. A suitable hydraulic conduit (not shown) connects port 40*d* with the usual pressure fluid control system provided in truck 10**.

Outer member 42, which is slightly smaller than cylinder 40, includes a tubular portion **42*a* which joins at its lower end in the figures with a piston head 42*b*. The outside diameter of portion 42*a* is slideably received within collar 40*c*, and is sealed thereto by an annular fluid seal 48. The upper end of member 42 in the figures is provided with a collar 42*c* which is similar in construction to previously mentioned collar 40*c***.

The outside diameter of piston head **42*b* is slideably received within tubular portion 40*a* of cylinder 40. An annular fluid seal 50 seals head 42*b* to wall portion 40*a*. Provided within piston head 42*b* are three fluid passages, or passage means, 52, 54, 56, 57. These are referred to herein respectively at first (52), second (54) and third (56, 57**) passage means, and also collectively as fluid-flow control means.

Passage 52 is disposed toward the upper side of the piston head in the figures, and extends radially in the piston head from approximately the axial center of the head to the outside thereof where it communicates with the space between the upper shoulder of the head and collar **40*c*. The inner end of passage 52 communicates with an axially extending bore 58 in which is secured an upwardly axially extending tube 60. The central axial passage within tube 60 cooperates with passage 52** as the above-mentioned first passage means.

Passage 54 extends in an axial direction through piston head **42*b*, and communicates both with the space between the bottom side of the head and base 40*b*, and with the space within tubular portion 42*a* of ram section 42**.

Passages 56, 57 are disposed on opposite sides of the piston head. Passage communicates through a radially extending bore 62 with the space between piston head **42*b* and collar 40*c*. A poppet check valve, or valving means, 64 is provided having a ball 64*a* joined with a downwardly projecting stem 64*b* which extends though a bore 66 that opens to the bottom side of the piston head. Provided in pasage 57 is an upwardly spring-biased relief valve 68 which normally blocks flow between passage 57 and a bore 70 which also communicates with the space between the piston head and collar 40*c***.

Intermediate ram section 44 is somewhat smaller than outer ram section 42. The intermediate ram section includes a tubular portion **44*a* which joins, adjacent its base, with a piston head 44*b*. The upper end of portion 44*a* is provided with a collar 44*c* which is similar to the two collars previously mentioned. The outside surface of portion 44*a* is slideably received by collar 42*c*, and is sealed thereto by a fluid seal 72. Piston head 44*b* is freely slideably received within tubular portion 42*a* of ram 42, and clearance therebetween, indicated by spaces 73, is provided to accommodate the bidirectional transfer of fluid between the opposite sides of piston head 44*b*. Piston head 44*b* is provided with a central axial bore 74 which slideably receives tube 60. A seal 76 seals head 44*b* to tube 60**.

Inner ram section 46 is slightly smaller than intermediate section 44. This section includes an elongated tubular portion **46*a* which joins adjacent its base with a piston head 46*b*. The upper end of section 46 is closed off, as indicated, by portion 46*c*. The hollow interior of section 46** opens to the base of the section.

Wall portion **46*a* is slideably received within collar 44*c*, and is sealed thereto by a fluid seal 78. Piston head 46*b* is freely slideably received within tubular portion 44*a*, with clearance provided therebetween in the same manner, and for the same general purpose, as the clearance space provided for head 44*b***.

The surface areas on ram sections 42, 44, 46, upon which pressure fluid acts to extend the ran are referred to herein as working surface areas. On section 42, this area constitutes the area of the bottom face of piston head **42*b* in the figures. This bottom face is also referred to as a high-pressure side for section 42. The low-pressure side of the section comprises the upwardly facing surface area of piston head 42*b* which is exposed to the upper end of cylinder 40. The working surface area on ram section 44 comprises the area of the bottom face of piston head 44*b* less the surface area of the outer upwardly facing rim portion of the head. This bottom face also constitutes the high-pressure side of section 44. The low-pressure side of section 44 comprises that area on the top side of piston head 44*b* which is exposed to the upper end of tubular portion 42*a*. Finally, the working surface area on member 46 is the combination of the downwardly facing surface areas of piston head 46*b* and of upper end portion 46a which are exposed to the inside of wall portion 44a, less the upwardly facing surface area on head 46b. This working surface area in section 46 is referred to as the high pressure side of the section. The low pressure side of the section takes the form of the upwardly facing surface area on the top side of piston head 46b which is exposed to the upper end of tubular portion 44a**.

Considering several important dimensional considerations, the working surface area on ram section 42 is substantially exactly equal to twice the difference between the working surface area on member 44 and the total cross-sectional area of tube 60. Further, the area of the upwardly facing portion of piston head 42b is substantially equal to the sum of the working surface area on inner ram section 46 and the total cross-sectional area of tube 60.

Considering now how the ram disclosed herein performs, the same is shown in a fully collapsed state in FIGS. 1, 3 and 4. In this state, and referring particularly to FIG. 4, it will be noted that valve 68 is closed, and that valve 64 is open. The latter valve is open by virtue of engagement between stem 64b and cylinder base 40b.

As will be apparent to those skilled in the art, the movements (extensions/contractions) relative to one another of the several sections in ram 20 are not sequence-controlled. The particular loads born by the movable ram sections, as well as friction therebetween and in the mast parts, dictate what exact sequence occurs at any particular time. In other words, what moves (and when) is not precisely predictable, and, in fact, doesn't matter so far as proper functioning of the invention is concerned. What now follows is a discussion of a typical movement sequence.

Describing extension of the ram, and assuming that pressure fluid is supplied to port 40d at a substantially constant rate, pressure fluid enters the ram and initially acts on the effective working surface areas of ram sections 42, 44, which sections then begin to extend relative to sections 40, 42, respectively. With slight movement of outer section 42 relative to cylinder 40, valve 64 closes to prevent the escape therethrough of fluid in the space between piston head 42b and collar 40c. With continued movement of the outer ram section, fluid is pumped from this just-mentioned space through tube 60 into the hollow interiors of ram sections 44, 46. Such pumping causes extension of inner ram section 46 relative to intermediate ram section 44.

With the various working surface areas related in size as described above, so long as the supply of pressure fluid to the ram occurs at a substantially constant rate, the overall rate of extension of the ram, between full contraction and full extension, is also substantially constant. Further, and as was mentioned above, there is no particular sequence of movements which necessarily occurs between the different ram sections. In other words, there may be times when all of sections 42, 44, 46 are moving simultaneously, and there may be other times when less than all of these sections move at once. Nevertheless, and with the conditions just described, substantially constant-rate extension occurs in the ram.

With initial extension of the ram, carriage 22 is raised on inner mast section 18 at a vertical travel speed which is substantially twice that of the extension speed of the ram. At substantially the same point in time that the carriage reaches its maximum "free lift," a fitting on the upper end of inner ram section 46c engages a plate 80 which is joined in a suitable fashion to the top of the inner mast section. With continued extension of the ram, inner mast section 18 is directly lifted through such engagement, and, through the action of boot strap chains 36, the ram lifts intermediate mast section 16 relative to outer mast section 14. Obviously, as the intermediate mast section lifts, ram 20 also lifts. When the ram has fully extended, the relative positions of its parts, as well as the positions of the carriage and mast parts, are as illustrated in FIGS. 2 and 5. It will be apparent that so long as the overall rate of extension of the ram is substantially constant, the vertical travel speed of carriage 22 relative to the ground continues to be substantially constant, and substantially twice the extension rate of the ram.

Contraction of the ram from the fully extended to fully contracted condition, and with fluid exhausting from the ram at a substantially constant rate, also is characterized by substantially constant contraction speed in the ram. It would be typical, for example, for the ram to contract in substantially the exact reverse sequence just described for extension.

Explaining with particularly the operations of valves 64, 68, during extension of the ram, and because of relative retraction of tube 60 from the inside of the hollow interiors of ram sections 44, 46, the volume of this space which requires pressure fluid is constantly increasing. While much of this increase is met by a supply of fluid from the space between piston head 42b and collar 40c, valve 64 allows the introduction, from the main supply, of any additional pressure fluid required to take care of the increase. Similarly, and with contraction of the ram, progressive volumetric decrease in the space in ram sections 44, 46 just mentioned must also be taken care of. In this situation, while most of the excess fluid is accommodated in the space between piston head 42b and collar 40c, any additional excess fluid escapes through opening of valve 68. Valves 64, 68 also accommodate situations such as heat-caused expansion (and subsequent contraction) of fluid captured in ram 20.

It will thus be apparent that the ram of the instant invention meets all of the objectives ascribed to it earlier. Its four-section construction allows it to have a relatively short vertical profile when fully contracted, which condition promotes good visibility for the operator of a lift truck. Especially significant is the fact that with pressure fluid supplied to and exhausted from the ram at a substantially constant rate, ram extension/contraction speed is also substantially constant. This important feature is one which negates the likelihood of jolting of a load during raising and lowering thereof.

It will further be observed that the construction of the proposed ram is relatively simple. This enables its manufacture at a relatively low cost, and also promotes good reliability.

While a preferred embodiment of the invention has been described herein, it is appreciated that variations and modifications may be made without departing from the spirit of the invention.

It is claimed and desired to secure by Letters Patent:

1. A three-stage, fluid-actuated, extensible-contractible device for an industrial lift truck or the like comprising first, second, third and fourth nested, relatively reciprocable sections, said first, second and third sections being extensible from said second, third and fourth sections, respectively, port means for introducing and exhausting pressure fluid to extend and contract said device, respectively, means on said first, second and third sections defining working surface areas on which pressure fluid acts to extend said sections, said area on said first section being less than that on said second section, and said area on said second section being less than that on said third section, and fluid-flow control means within said device for controlling the distribution of fluid therein, said control means including first, second and third passage means provided within said third section, said first passage means accommodating throughout length-change in said device fluid communication between said second and fourth sections, said second passage means accommodating throughout length-change in said device fluid communication between said third and fourth sections, and said third passage means accommodating throughout length-change in said device communication between opposite end portions in said fourth section, said second passage means causing said working surface area on said second section to be exposed, under all operating conditions, directly to the same pressure fluid acting on said working surface area on said third section, said control means, with pressure fluid supplied to said port means at a substantially constant rate, and in cooperation with said areas, producing a substantially uniform overall extension speed for said device.

2. The device of claim 1, wherein said third passage means includes first and second valving means, said first valving means permitting, under certain circumstances, fluid flow from one of said end portions to the other end portion and blocking flow in the reverse direction, and said second valving means permitting, under certain other circumstances, fluid flow from said other end portion to said one end portion and blocking flow in the reverse direction.

3. A multistage, fluid-actuated telescopic ram providing a substantially constant overall length increase from its fully contracted to its fully extended condition upon being supplied pressure fluid at a substantially constant rate, said ram comprising:

a cylinder having fluid inlet means therein;

an outer telescoping member nested in said cylinder and adapted for movement to an extended position relative thereto;

an intermediate telescoping member nested in said outer member and adapted for movement to an extended position relative thereto;

an inner telescoping member nested in said intermediate member and adapted for movement to an extended position relative thereto;

said outer, intermediate and inner members each having a high-pressure side and a low-pressure side, and each including a working surface area on its high-pressure side on which pressure fluid acts to move the member toward its extended position, the area on said intermediate member being substantially one-half that of said area on said outer member; and a plurality of fluid passage means within said ram for controlling the distribution of fluid therein, said passage means including a first passage means accommodating, throughout lengt-change in said ram, fluid communication between the low-pressure side of said outer member and the high-pressure side of said inner member, a second passage means accommodating, throughout length-change in said ram, fluid communication between the high-pressure side of said outer member and the high-pressure side of said intermediate member, and a third passage means accommodating, throughout length-change in said ram, fluid communication between the opposite sides of said outer member, said second passage means causing said working surface area on said second section to be exposed, under all operating conditions, directly to the same pressure fluid acting on said working surface area on said third section.

4. The ram of claim 3, wherein said third passage means includes first and second valving means, said first valving means permitting, under certain circumstances, flow from the low-pressure side of said outer member to the high-pressure side thereof while blocking flow in the reverse direction, and said second valving means permitting, under certain other circumstances, fluid flow from the high-pressure side of said outer member to the low-pressure side thereof while blocking flow in the reverse direction.

* * * * *